US006824585B2

(12) United States Patent
Joseph et al.

(10) Patent No.: US 6,824,585 B2
(45) Date of Patent: Nov. 30, 2004

(54) LOW COST HIGH SPEED TITANIUM AND ITS ALLOY PRODUCTION

(75) Inventors: Adrian A. Joseph, Laguna Niguel, CA (US); John G. Whellock, Castle Rock, CO (US)

(73) Assignee: Adrian Joseph, Temewla, CA (US)

( * ) Notice: Subject to any disclaimer, the term of this patent is extended or adjusted under 35 U.S.C. 154(b) by 0 days.

(21) Appl. No.: 10/309,552

(22) Filed: Dec. 3, 2002

(65) Prior Publication Data

US 2004/0103751 A1 Jun. 3, 2004

(51) Int. Cl.[7] ..... C22B 4/06; C22B 34/12
(52) U.S. Cl. ..... 75/10.19; 75/10.21; 420/590
(58) Field of Search ..... 75/10.19, 10.21; 420/590

(56) References Cited

U.S. PATENT DOCUMENTS

| | | | | |
|---|---|---|---|---|
| 2,727,937 A | | 12/1955 | Boyer | |
| 2,997,760 A | | 8/1961 | Hanks et al. | |
| 3,210,454 A | | 10/1965 | Morley | |
| 3,237,254 A | | 3/1966 | Hanks et al. | |
| 3,342,250 A | | 9/1967 | Treppschuh et al. | |
| 3,343,828 A | | 9/1967 | Hunt | |
| 3,467,167 A | | 9/1969 | Mahin | |
| 3,494,804 A | | 2/1970 | Hanks et al. | |
| 3,546,348 A | | 12/1970 | Serafino | |
| 3,549,353 A | | 12/1970 | Sterling et al. | |
| 3,607,222 A | | 9/1971 | Kennedy | |
| 3,764,297 A | | 10/1973 | Coad et al. | |
| 4,027,722 A | | 6/1977 | Hunt | |
| 4,035,574 A | | 7/1977 | Kennedy | |
| 4,488,902 A | | 12/1984 | Hunt | |
| 4,793,854 A | | 12/1988 | Shimotori et al. | |
| 4,828,608 A | | 5/1989 | McNamara et al. | |
| 4,838,340 A | | 6/1989 | Entrekin et al. | |
| 5,503,655 A | | 4/1996 | Joseph | |
| 6,136,060 A | * | 10/2000 | Joseph | 75/10.19 |
| RE37,853 E | * | 9/2002 | Detering et al. | 75/10.19 |

FOREIGN PATENT DOCUMENTS

| | | |
|---|---|---|
| CA | 549299 | 11/1957 |
| GB | 809444 | 2/1959 |

* cited by examiner

*Primary Examiner*—Melvyn Andrews
(74) *Attorney, Agent, or Firm*—Liner, Yankelevitz, Sunshine & Regenstreif, LLP

(57) ABSTRACT

A method for refining a titanium metal containing ore such as rutile or ilmenite or mixtures to produce titanium ingots or titanium alloys and compounds of titanium involves production of titanium tetrachloride by processing the ore with a chlorinating procedure and removing various impurities by a distillation or similar procedures to form a relatively pure titanium tetrachloride. Thereafter, the titanium tetrachloride is introduced continuously into a reactor at the focal point of a plasma under atmospheric pressures of inert gas along with molten metallic reductant for the initial reduction of gas phase titanium tetrachloride into molten titanium drops which are collected in a set of skulled crucibles. Thereafter, further processing is carried out at atmospheric pressures in under inert gas where the titanium is heated by plasma guns to maximize titanium purity and, in a final optional stage, alloying compounds are added under the same controlled environment and high temperature conditions.

10 Claims, 5 Drawing Sheets

40
51
50
54
52
41
53
52
55
57
56
59
54a
56a
45
43
110

LOW COST HIGH SPEED TITANIUM AND ITS ALLOY PRODUCTION

BACKGROUND OF THE INVENTION

The present invention relates to processing of titanium bearing ores and more specifically to an improved process for low cost and high speed extraction, production and refining of titanium and titanium alloys.

The present invention is a further improvement of Dr. Joseph's prior patents, U.S. Pat. No. 5,503,655 issued Apr. 2, 1995 and U.S. Pat. No. 6,136,060 issued Oct. 24, 2000, the disclosures of which are incorporated herein by reference. The first patent describes a process in which a liquid slag containing titanium dioxide is reduced to a mixture of titanium dioxide and iron; the iron is then separated out to produce about 95% pure titanium dioxide. In subsequent processing, the partially pure titanium dioxide is melted and processed to remove any residual iron and other impurities to form titanium dioxide powder.

The second patent discloses a process for production of titanium and titanium alloys using a reductive process under vacuum. The reduction step is carried out by molten metallic sodium, whereas in the present disclosure, the reductant could be any of magnesium, sodium, hydrogen, lithium, potassium, rubidium, cesium, francium, beryllium, calcium, strontium, barium or radium.

Canadian Patent No. 549299 to Gross et al. discloses the production of titanium metal by decomposing titanium halides under controlled temperatures. U.S. Pat. No. 4,793,854 to Shimotori et al. produces titanium by electrolysis of molten titanium slat followed by purification under high vacuum conditions.

A large number of prior art references describe various aspects of refining metals and particularly refining titanium. Great Britain Patent No 809,444 , U.S. Pat. No. 3,546,348 to DeCorso and U.S. Pat. No. 3,764,297 to Coad et al. describe the use of electric arcs under vacuum to melt metals. U.S. Pat. No. 2,997,760 to Hanks et al. describes melting metals under vacuum to remove volatile impurities. U.S. Pat. No. 3,237,254 (Hanks et al.), U.S. Pat. No. 3,342,250 (Treppschuh et al.) and U.S. Pat. No. 3,343,828 (Hunt) describe melting metals under vacuum with electron beam guns. U.S. Pat. No. 3,494,804 to Hanks et al. also describes vacuum heating with an electron beam gun and discloses the idea of using a "skull" to prevent contamination of a melt by the walls of a crucible. U.S. Pat. No. 4,027,722 to Hunt and U.S. Pat. No. 4,488,902, also to Hunt, describe additional details of electron beam based processes U.S. Pat. No. 3,210,454 to Morley and U.S. Pat. No. 4,838,340 to Entrekin et al. disclose the use of plasma torches to maintain metals in a molten state.

Titanium, especially some of its alloys such as titanium-aluminum-vanadium (Ti-6Al-4V) are important because they are ideally suited for a wide variety of applications in the aerospace, aircraft, military, and automotive fields. Titanium and its alloys, including that mentioned, combine the attractive properties of high strength and light weight with resistance to corrosion and stability under high temperatures. For example, titanium is very strong but only about 60% as dense as iron and parts made of titanium will weigh only 60% as much as the same part made of steel. While titanium is relatively easy to fabricate, there are numerous impediments to its widespread use. As demonstrated by the above cited references, refining titanium is energy intensive and involves significant costs in handling due to the need for toxic chemicals for its refining. Furthermore, in refining titanium, there may also be a high cost involved in disposing of the toxic byproducts produced in the refinery process.

Thus, it is a primary object of this invention to provide an improved and cost effective process for the production of high purity titanium and its alloys from a starting ore containing titanium, preferably in an oxide form.

Another object of the present invention is the conversion of a titanium bearing ore such as rutile or ilmenite to an essentially pure titanium tetrachloride followed by reduction to titanium which is then followed by refining of the titanium to a pure state and optionally alloying the same.

These objects and features of the present invention will become more apparent from the following detailed description which provides detailed information regarding both the process and apparatus and which is for purposes of illustration and should not be construed as a limitation on the present invention.

SUMMARY OF THE INVENTION

The present invention is a process for refining titanium containing ore and more particularly a sequence which involves converting the titanium ore to titanium tetrachloride, the latter continuously reduced to titanium metal in a plasma reactor in the presence of a metallic reductant under inert gas at atmospheric pressures. The resulting titanium is continuously fed and further processed to a relatively high purity while molten and under inert gas at atmospheric pressures followed optionally by alloying with other metals such as aluminum and vanadium.

First, titanium tetrachloride is produced from the ore and many of the impurities such as iron chloride and vanadium are removed in this step resulting in an intermediate with less than four parts per billion.

Then the titanium tetrachloride is reduced with molten magnesium or sodium, or alternatively with lithium, potassium, rubidium, cesium, francium, beryllium, calcium, strontium, barium or radium under inert gas at atmospheric pressures in a plasma reactor preferably using a hydrogen plasma. Thereafter, the molten titanium is processed in the presence of inert gas under atmospheric pressures (approximately 760 Torr ) and elevated temperatures. During this processing alloying optionally may take place.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
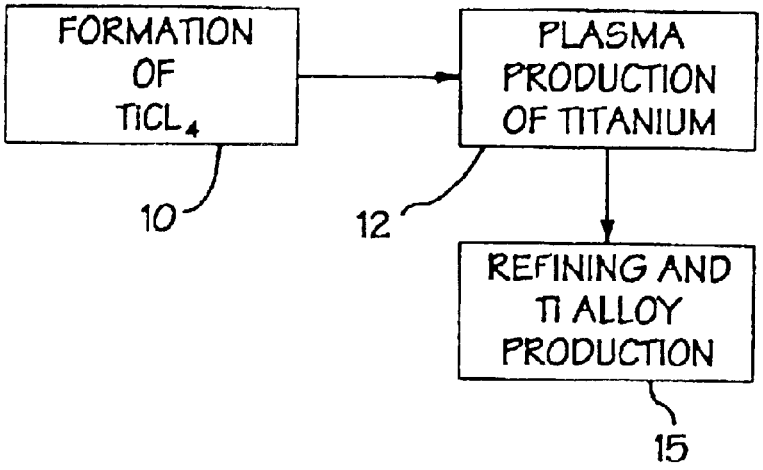
FIG. 1 is a diagrammatic illustration of the general steps for production of titanium alloy from titanium ore in accordance with the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The process previously patented by Dr. Joseph utilizes sodium as a reductant, and produces high-grade titanium metal from titanium tetrachloride under vacuum conditions. In the improved process, magnesium, lithium, potassium, rubidium, cesium, francium, beryllium, calcium, strontium, barium or radium can also be used as the reductant instead of sodium. Because of cost and toxicity sodium or magnesium are preferred.

The choice of reductant between sodium and magnesium can be based on:

Suitability for reaction—thermodynamics and kinetics;

Cost of the reductant;

Ease of delivery or handling;

Disengagement of the products; and

Safety.

The following table of physical characteristics is useful for making this selection:

| Component | Melting Point ° C. | Boiling Point ° C. |
|---|---|---|
| Na | 98 | 882 |
| Mg | 650 | 1105 |
| Ti | 1667 | 3285 |
| $TiCl_4$ | −25 | 137 |
| NaCl | 801 | 1465 |
| $MgCl_2$ | 714 | 1418 |
| $TiCl_3$ | 730 | 750 |

Thermodynamic analysis shows no real benefit of sodium over magnesium as reductant as far as can be discerned from equilibrium considerations. From the Kroll and Hunter processes (see *Hawley's Condensed Chemical Dictionary* (11th ed. 1987)) it appears that any of the reduction reactions is possible and no data have been found to support a preference for one reductant over the others.

Kinetic data in a publication by Tisdale et al. give some useful indicators that the reaction of titanium tetrachloride with magnesium metal is sufficiently fast in the vapor phase at 1150–1250° C. to preclude concerns over excessively long reaction times for a continuous process. "Vapor phase titanium production", D. G. Tisdale, J. M. Toguri, and W. Curlook, CIM Bulletin, March 1997:159–163.

The cost of the reductant metal is a major consideration. Sodium and magnesium have similar atomic weights, but on a molar basis only one half as much magnesium is required. Therefore, there is less reductant to heat up to reaction temperatures with magnesium, thus lowering energy input. The fact that magnesium is currently in abundance and roughly half the cost of the sodium per pound or kilogram is an additional point in its favor.

Both magnesium and sodium are flammable and great care should be exercised in their handling. Sodium melts at a much lower temperature: so maintaining feed systems in the molten state is simpler. It is however more reactive with water and has to be stored under paraffin, as it will oxidize rapidly in air. Magnesium on the other hand can be delivered as ingots or "bricks" and is stable at room temperature. The products of the reactions have their respective advantages and disadvantages. The reactor has to be held above the condensation point of the reactants and products to enable good separation of the products. Reference to the database of physical properties allows one to estimate optimal reaction temperatures for any set of reactants.

To evacuate the process stream of product chloride and metal requires an operating temperature of at least 1465° C. Alternatively, sufficient flushing gas such as argon must be provided to assure that the walls of the vessel are above the dew point determined by the vapor pressure of any residual chloride or metal in this gas stream. While sodium metal is clearly more volatile than magnesium and therefore should be easily stripped from the melt at high temperatures, it actually has a marginally higher boiling point than magnesium chloride.

Development of a low cost, high speed, continuous or near-continuous process for producing high-grade titanium metal which is essentially pure, represents a great improvement in the field of metallurgy, and satisfies a long felt need for a commercial process with a high potential capacity, but which is less labor intensive. Further, any component which will make the process even more cost effective and efficient is beneficial.

Referring to the drawings which illustrate a preferred embodiment of this invention, the general flow diagram of FIG. 1 shows the general sequence of steps. The first step 10 includes the formation of essentially pure titanium tetrachloride ($TiCl_4$) from a starting titanium bearing ore such as rutile or ilmenite or mixtures of ores. Rutile is an ore containing titanium and oxygen ($TiO_2$) while ilmenite is an ore containing iron, titanium and oxygen ($TiO_2Fe_2O_3$). For the purposes of this invention, any titanium containing ore or mixtures of ores preferably with oxygen, with or without other metals, may be used as the starting ore. The titanium ore is dressed in a conventional manner to produce an ore concentrate. In effect, the first general step 10 includes conversion of the starting ore to titanium tetrachloride preferably having less than 4 parts per billion of metallic impurities since the latter are difficult to remove in later processing. Generally, this step includes reacting chlorine with the ore to form titanium tetrachloride.

The next general step 12 involves conversion of the essentially pure titanium tetrachloride to titanium metal by plasma arc treatment in a chemical reduction process resulting in the reduction of the $TiCl_4$ to titanium and $2(XCl_2)$, where X is a divalent reductant such as beryllium, magnesium, calcium, strontium, barium or, radium, or 4(YCl), where Y is a monovalent reductant such as lithium, sodium, potassium, rubidium, cesium or francium. In this second general step 12, a plasma reactor 40 (FIG. 3, to be described below) is used in which magnesium, sodium, lithium, potassium, rubidium, cesium, francium, beryllium, calcium, strontium, barium or radium is melted if necessary, and is injected continuously into a reaction chamber with heated titanium tetrachloride resulting in the formation of titanium metal and $2(XCl_2)$, or 4(YC1), depending on the choice of reductant.

The third general step 15 involves processing the titanium from the second step under a controlled environment in which the titanium is heated and kept molten by plasma guns 130 (FIG. 5) and at controlled environment conditions resulting in a very pure titanium metal which can be cast into ingots 125 or converted to an aluminum-vanadium alloy while the titanium metal is in liquid form. In this third general step 15, dissolved gases such as hydrogen and chlorine are removed by out gassing. Since out gassing generally cannot remove oxygen, nitrogen and carbon, the entire process takes place at atmospheric pressures in an inert gas environment to flush out these impurities.

Figure 2:
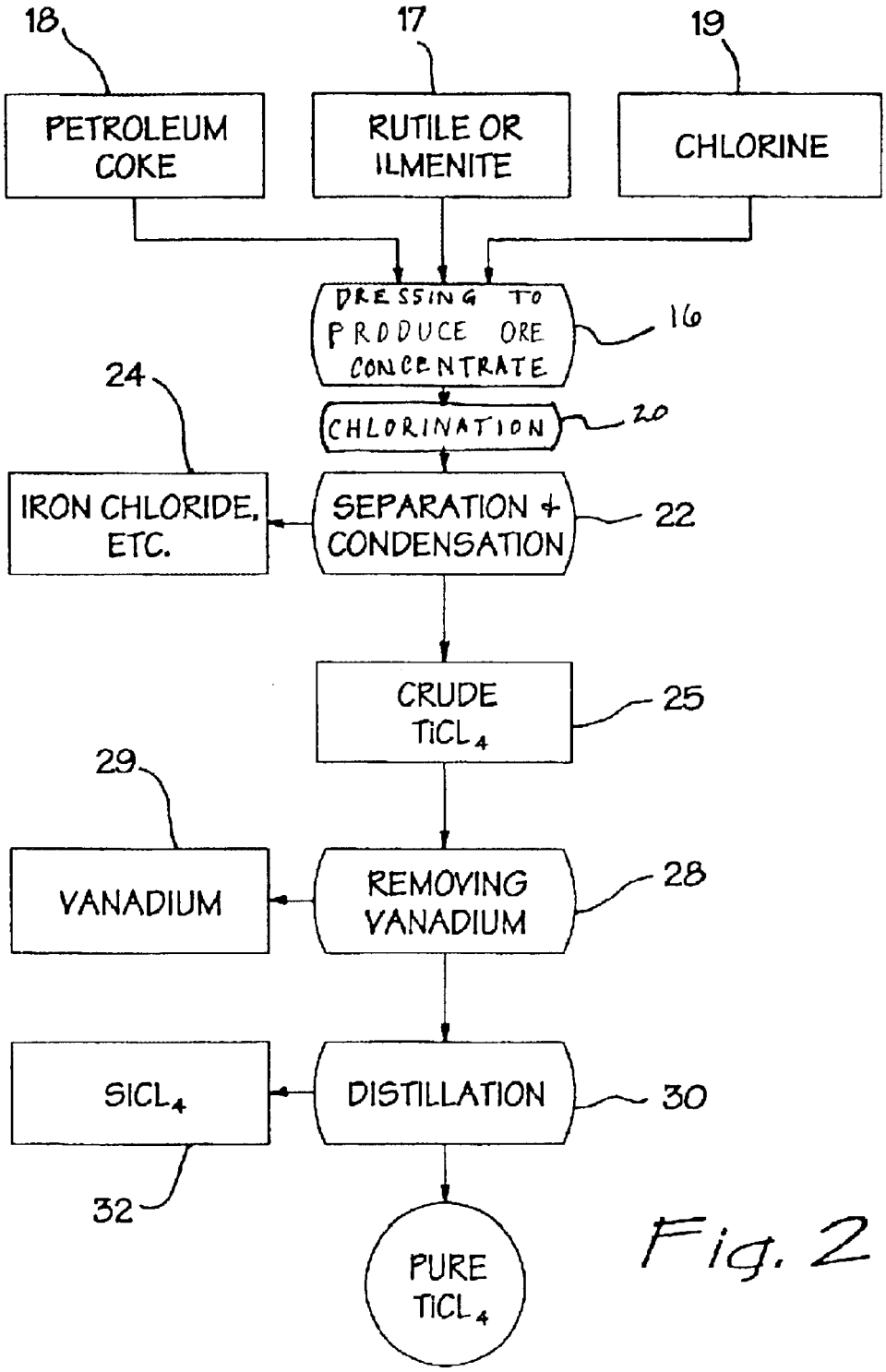
FIG. 2 is a process flow sheet for the production of titanium tetrachloride in accordance with this invention.

FIG. 2 illustrates the details of the process involved in the first general step 10 shown in FIG. 1 for the production of titanium tetrachloride from a suitable ore. As shown, a titanium and oxygen bearing ore 17 such as rutile or ilmenite or mixtures, is dressed 16 with petroleum coke 18 and chlorine gas 19 and processed in a chlorination step 20 at an elevated temperature. After chlorination 20, the mixture contains titanium tetrachloride and iron chloride and other impurities which are separated out in a separation and condensation step 22. The impurities are separated at 24 resulting in the formation of a crude titanium tetrachloride as shown at 25.

The crude titanium tetrachloride 25 is then processed at 28 to remove vanadium, as shown at 29, followed by distillation at 30, again at an elevated temperature, to remove silicon chloride as shown at 32. After removal of vanadium 29 and silicon chloride 32, the concentration of impurities is preferably below about 4 parts per billion. The result is essentially pure titanium tetrachloride ($TiCl_4$).

Thus, the first detail step within the first general step 10 involves ore dressing 16 to produce an ore concentrate. The second detail step involves chlorination 20 of the ore concentrate to form crude metal 25. This second detail step involves two separate sub-steps:

(a) Conversion of the ore concentrate to crude $TiCl_4$ 25. This is done in the chlorination process 20 and is represented by the reaction (where "s" indicates solid and "g" indicates gas):

$$TiO_2(s)+2Cl_2(g)+2C(s)\rightarrow TiCl_4(g)+2CO(g)$$

The chlorination process 20 is carried out in a chlorinator. With rutile ores, in the case of ilmenite, iron chloride is also formed and has to be removed as a separate step 22.

(b) The crude $TiCl_4$ 25 is further purified 28, 30 to remove vanadium 29 and silicon 32 impurities. The final product is pure $TiCl_4$. All the metallic impurities have to be removed, in this step since they cannot be removed subsequently.

The next general step 12 is the plasma arc reduction of titanium tetrachloride in the presence of gaseous hydrogen for the plasma and molten metallic magnesium, sodium, lithium, potassium, rubidium, cesium, francium, beryllium, calcium, strontium, barium or radium reductant to produce titanium and $2(XCl_2)$, where X is divalent reductant such as beryllium, magnesium, calcium, strontium, barium or, radium, or 4(YCl), where Y is a monovalent reductant such as lithium, sodium, potassium, rubidium, cesium or francium according to the equation:

$$TiCl_4+2X\rightarrow Ti+2(XCl_2)$$

where X is beryllium, magnesium, calcium, strontium, barium or, radium, or $$TiCl_4+4Y\rightarrow Ti+4(YCl)$$

where Y is lithium, sodium, potassium, rubidium, cesium or francium.

Figure 3:
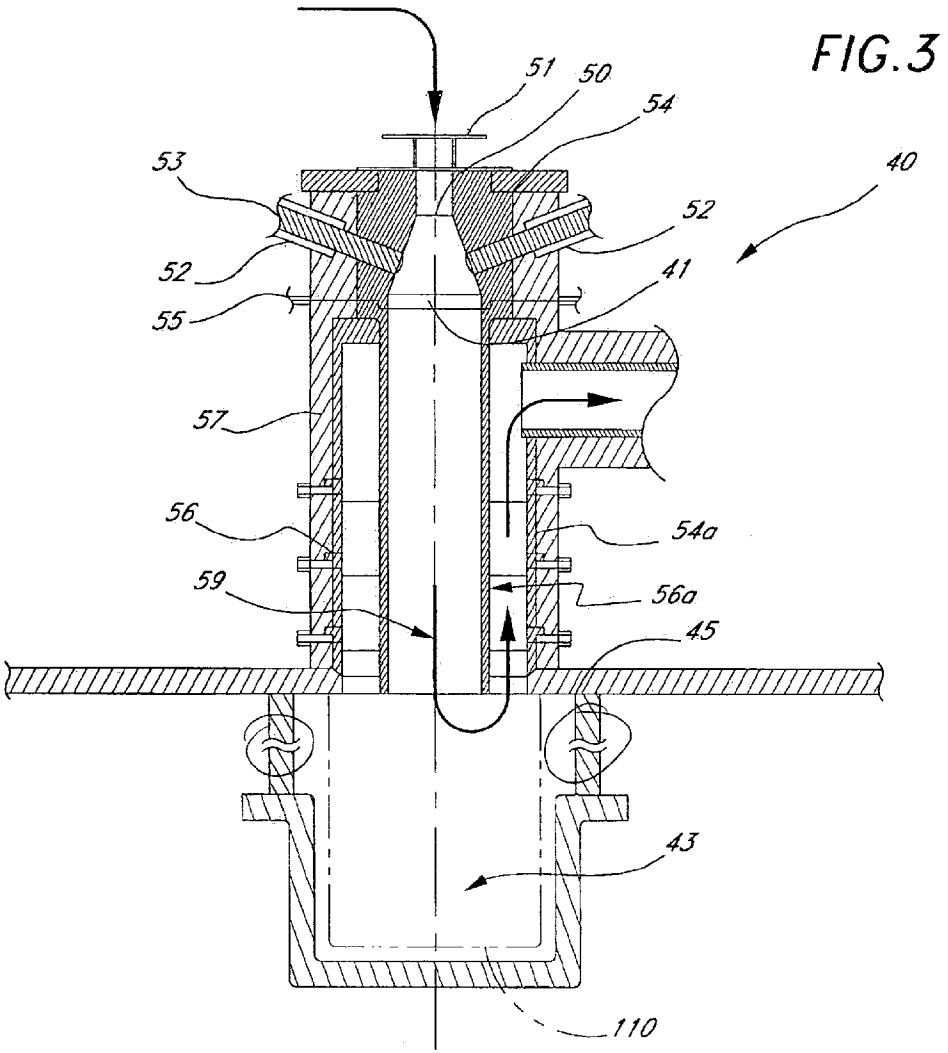
FIG. 3 is a sketch of the plasma reactor for the reduction of titanium tetrachloride in accordance with this invention.

The plasma reduction step 12 may be carried out in an apparatus 40 illustrated in FIG. 3 and referred to as a plasma reactor utilizing an inert atmosphere of argon or helium. The reactor 40 includes basically two zones both of which contain inert gas at atmospheric pressures. The upper zone 41 contains the plasma arc in which the reduction occurs, and the lower zone 43 is the input side of the refining and alloying apparatus (step 15 of FIG. 1; illustrated in FIG. 5) also at a controlled pressure of about 760 Torr, as are later stages. The two zones 41, 43 are separated by a flange 45, from which is suspended a collar 107 holding collector crucible 110 (to be described).

The top portion 50 of the reactor 40 includes an injection port 51 through which the reductant metallic magnesium, sodium, lithium, potassium, rubidium, cesium, francium, beryllium, calcium, strontium, barium or radium (herein after, metallic reductant) is introduced into the reactor 40. Surrounding the top portion 50 is a graphite block 54 for high temperature resistance.

The metallic reductant is heated and melted (if necessary) by a plurality of plasma torches 52 arranged at a tilted down 60 degree angle and disposed circumferentially at 120 degrees from each other, two being shown at 52, and located vertically below the metallic reductant injection port 51. The metallic reductant is introduced at the focal point of the torches 52, as illustrated diagrammatically as "*". Located vertically below the torches 52 is a titanium tetrachloride injection port 55 such that the molten metallic reductant comes into intimate contact with the injected titanium tetrachloride and is intermixed therewith for reaction. A constant stream of inert gas (such as argon or helium) and hydrogen for the plasma is introduced into zone 41 through ports such as ports 53 that can be coaxial with the torches 52. Located vertically below the titanium tetrachloride injection port 55 is a dual reactor section 57, 58, including a graphite liner 54*a*, for reaction between the molten metallic reductant and the heated titanium tetrachloride. Graphite rings 56 are used for temperature resistance, and within the reactor sections 57, 58 are temperature resistant graphite columns 56*a*. Vertically below the reactor sections 57, 58 is a separator section 59 through which the $2(XCl_2)$ or 4(YCl) is withdrawn through an exhaust system (not shown). Titanium metal in the form of molten titanium droplets passes from the separator 59 into region 43 and the crucible 110 which links the reactor 40 to the refining apparatus 100.

Figure 4:
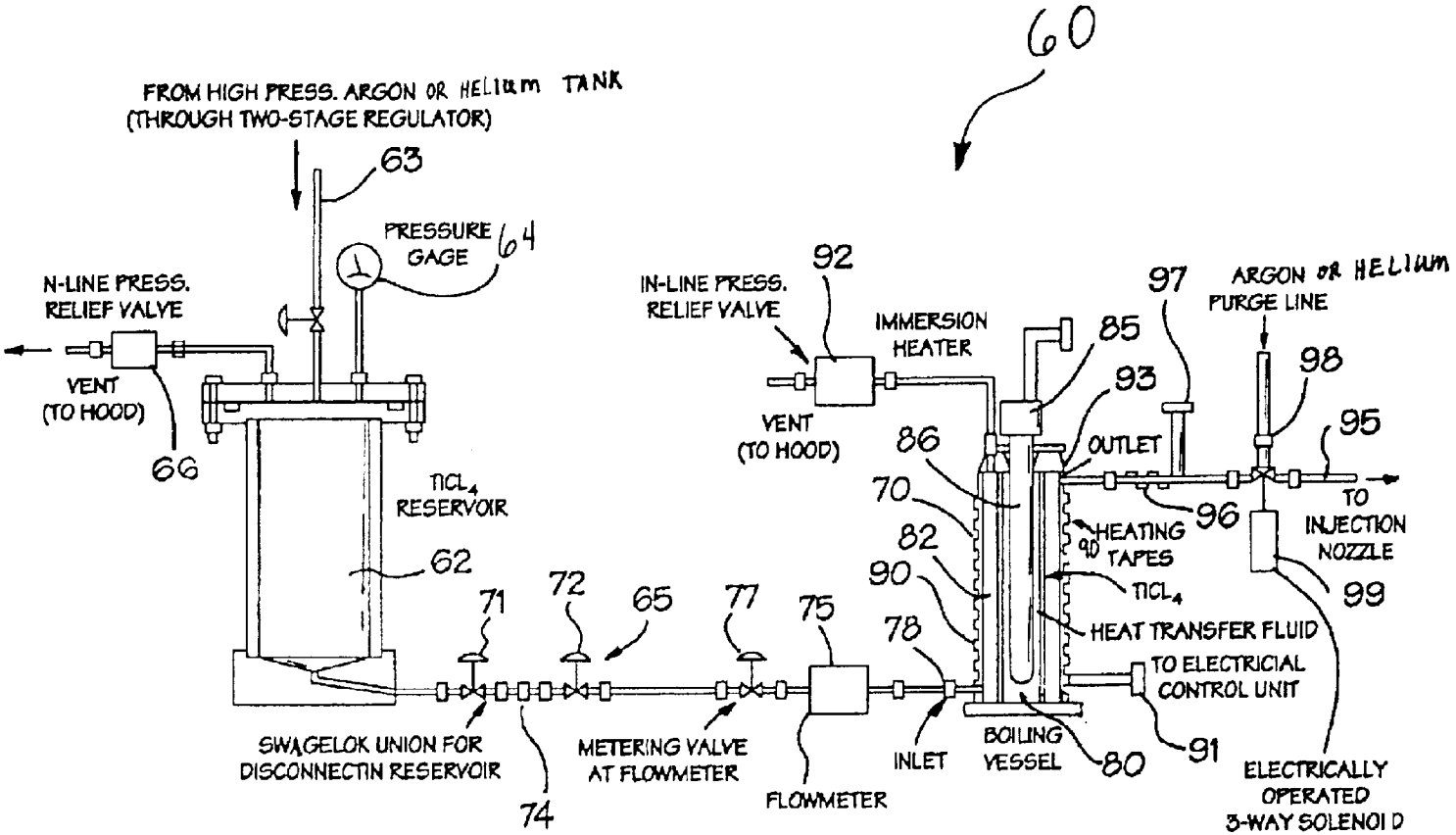
FIG. 4 is an illustration of the titanium tetrachloride supply system used with the plasma reactor of FIG. 3 in accordance with this invention.

A titanium tetrachloride supply system 60 for titanium tetrachloride injection into the plasma reactor 40 is illustrated diagrammatically in FIG. 4. The supply system 60 includes a sealed titanium tetrachloride reservoir tank 62 which receives relatively pure titanium tetrachloride from the distillation step 30 of FIG. 2. The tank 62 includes an inert gas supply system 63 for argon or helium gas, for example, supplied from a pressurized gas source such as an argon or helium gas tanks (not shown) through a two-stage pressure regulator. The tank 62 also includes an in-line pressure relief valve 66 which may vent to a hood and a pressure gage 64 to monitor the internal pressure of the tank 62. The tank 62 also includes an outlet system 65 whose output is connected to a titanium tetrachloride-boiler vessel 70.

The outlet system 65 includes a series of manually operated valves 71, 72 and Swagelok® unions 74 for disconnecting the reservoir tank 62 from the remainder of the system 60. Down stream of the valves 71, 72 is a flowmeter 75 controlled by a manually operated valve 77. The outlet 78 of the flowmeter is connected as the inlet at the bottom of the boiler vessel 70. The boiler vessel 70 itself includes an inner heater section 80 and an outer titanium tetrachloride heater chamber 82. The heater chamber 82 surrounds the heater section 80 and is sealed relative thereto. The titanium tetrachloride is fed into the heater chamber 82 under a blanket of argon or helium gas.

The heater section 80 includes an immersion heater assembly 85 which includes an immersion heater device 86 which extends into the heater section 80 and which is supported at the top of the tank 70 by means well known in the art. The immersion heater 86 may be any one of the immersion heaters well known in the art. As shown, the immersion heater 86 is spaced from the wall forming the heater chamber 82 and is preferably filled with a heat transfer fluid for effective transmission of heat from the immersion heater 86 to the wall of the chamber 82.

Surrounding the outer wall of the tank 70 is a heater tape unit 90 connected to a source of electrical power through a junction 91. Mounted at the top of the tank 70 and communicating with the heater chamber 82 is an in-line pressure relief valve 92 which vents to a hood. The tank 70 and the heater chamber 82 include an outlet 93. The exit side 95 of the outlet forms the inlet injection nozzle for the injector 55 of the plasma reactor 40 of FIG. 3. The outlet system 93 from tank 70 includes heating tapes 96 supplied with power from a junction 97. Downstream of the tapes 96 is an argon or helium purge valve 98 controlled by a three way electrically operated solenoid valve 99.

Figure 5:
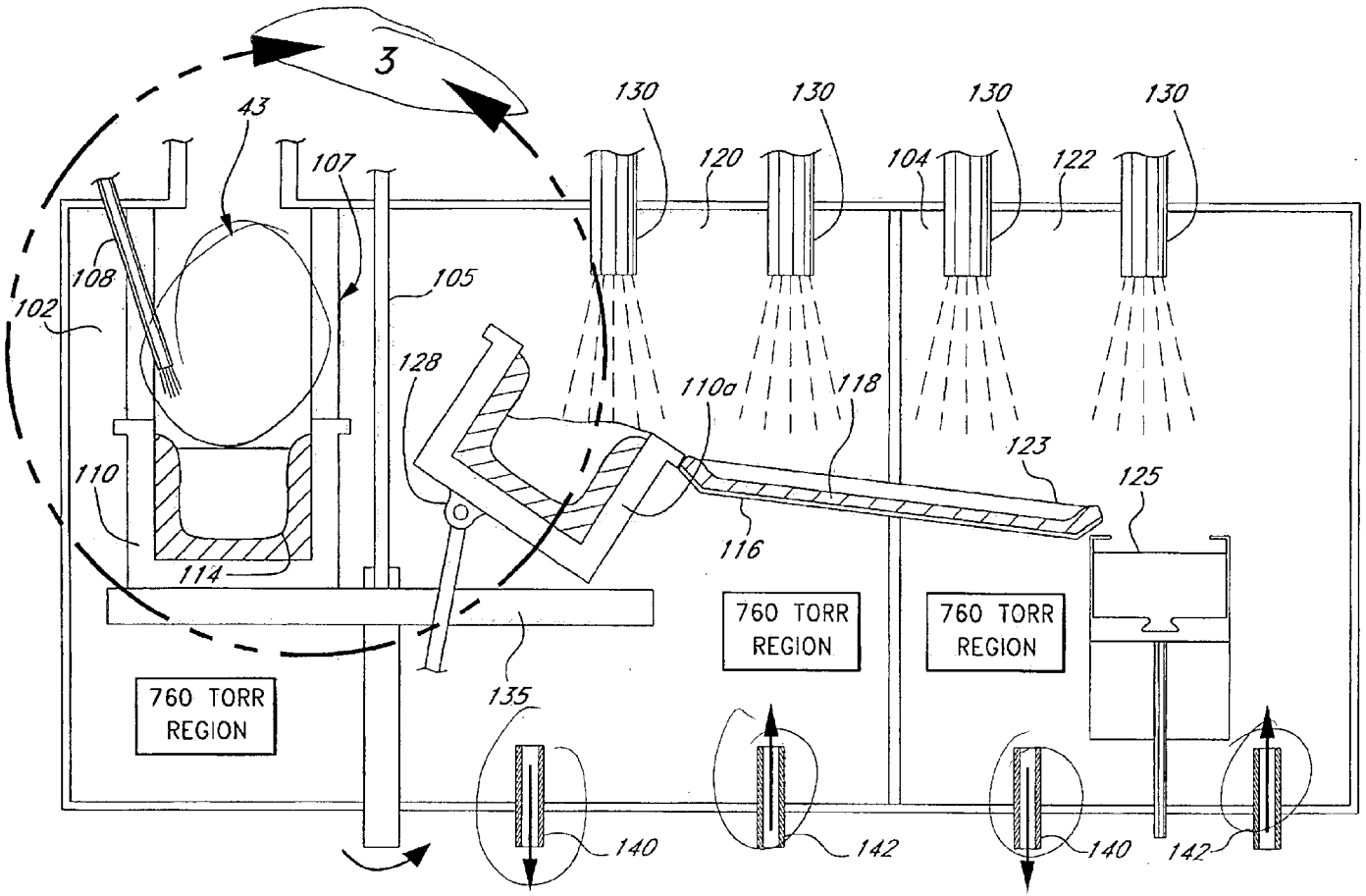
FIG. 5 is an illustration of the apparatus for the steps of titanium alloying and purification following reduction.

The apparatus 100 for refining and/or alloying the titanium metal output from the device of FIG.3 is shown in FIG. 5. The apparatus 100 includes multiple chambers 102, 104 separated into two general zones by a gate valve 105 (as shown). The zone 102 on the left contains an input through the collar 107 from the titanium reduction plasma apparatus 43 (FIG. 3), and additional plasma gun 108 for heating the titanium carrying ceramic vessel or crucible 110 and the molten titanium as it is produced. Zone 102 is at atmospheric pressure, e.g. 760 Torr, and receives molten titanium, in the form of titanium droplets, from the section 43 of the reactor 40. The liquid titanium droplets entering section 102 through the collar 107 are heated by the plasma gun 108 and the gun output impinges on a molten titanium pool in the ceramic vessel or crucible 110 provided with a water cooled copper insert (FIG. 3) on which titanium has previously solidified on the crucible walls to form a skull or solidified titanium coating 114 of essentially pure titanium metal. The titanium skull 114 prevents the molten titanium from contacting the bare walls of the crucible 110 which would result in reaction with resultant contamination of the titanium. Thus, incoming molten titanium contacts the solid titanium coating 114 of the crucible 110, the coating 114 being maintained solid by the water cooled insert in the ceramic crucible 110.

The zone 104 on the right of zone 102 is also at 760 Torr (atmospheric pressure) and contains a hearth 116 on which a titanium skull 118 has been previously formed. The copper hearth 1 16 may be cooled by interior water cooling pipes, not shown. There are multiple sections in this zone: the first section 120 at atmospheric pressure; the next and successive section 122 is at the same pressure as the first section, e.g., 760 Torr, the final section 122 including the cold hearth 116 having a lip 123 over which the molten metal flows to be cast into a retractable ingot mold 125. Plasma guns 130 keep the titanium molten in each of these sections. Alloying elements can be introduced into the second section 122 operating at 760 Torr so that an alloy, as previously described, may be formed. To form the alloy mentioned, powdered aluminum in an amount of 6% by weight and powdered vanadium in an amount of 4% by weight are introduced into the chamber 122. The flow rate through the sections 120, 122 has to be a constant if the proper amount of alloys are to be introduced to meet alloy specifications.

There may be one to three ceramic vessels or crucibles 110, 110*a* with titanium skulls 114, 114*a*, formed as described. The ceramic crucibles 110, 110*a* are positioned and supported on a table 135 which can be rotated 180 degrees so that the crucible 110, 110*a* full of molten titanium can be swung from zone 102 into the left part of zone 104 (of section 120). There is also a tilt mechanism 138 in the left position of zone 104 (of section 120) which permits the molten titanium to be gradually poured over the sloping hearth 116 and flow from left to right and be cast into an ingot in mold 125. As shown, each of sections 120 and 122 includes exit ports 140 for degassing control. These zones are constantly purged by inert gas (such as argon or helium ) entering through input ports 142.

With this design, the reduced titanium metal collection rate in zone 102 is independent of the flow rate on the hearth 116 in zone 104. Since two vastly different technologies are operating in the zones 102 and 104, it is almost impossible to match the reduction rate in the right zone 102 to the flow rate on the hearth 116 in the left zone 104.

In operation, the first step is to turn on the plasma guns 108 and melt the surface of the skull 114 in zone 102. In the next step, the plasma reduction reactor is brought into operation, and the newly reduced titanium falls onto the molten surface of the skull 114 to fill it up.

Once the skull 1 14 is filled, the succeeding step is to open the gate valve 105 between zones 102 and 104 and swing the crucible 110 full of molten titanium to zone 104 while an empty skull 114 swings to position in zone 102. Alternate arrangements as may be apparent to those skilled in the art may also be used for this operation. The next step is to close the gate valve 105 isolating the two zones 102 and 104.

Following the closure of the gate valve 105, the plasma guns 130 in zone 104 are turned on to melt the surface of the skull 118 in the sloping hearth 116. The crucible 110*a* full of molten titanium is tilted and poured at a steady rate onto the hearth 116 so that the gaseous contaminants, chlorine and hydrogen, are removed by outgassing and the titanium is cast into the ingot mold 125. The rate at which the metal is poured over the hearth 116 depends on the quantity of gases present in the titanium from the reduction step. The larger this quantity, the slower the rate so as to give enough time for degassing to occur. A constant flow of inert gas entering ports 142 carries the contaminants away through exit ports 140.

While the preceding step is occurring in zone 104, the first step is operational in zone 102. The virtue of this arrangement is that the processing rates in the left 102 and right 104 zones can be controlled independently of each other to achieve an overall steady production rate.

This process produces reduced titanium free from dissolved impurities, i.e., chlorine, oxygen, nitrogen, carbon, and hydrogen. Chlorine and hydrogen can be readily removed by exposing the molten titanium surface to high velocity argon or helium plasma, while keeping the titanium sufficiently hot so that it can be cast as an ingot after the degassing operation. As noted, oxygen, nitrogen and carbon cannot be removed in this late stage and hence must be kept out of the titanium by carrying out all processing in an environment where the partial pressures of these gases is very low, i.e., in an inert atmosphere, taking great care that there are no leaks to or from the atmosphere in any of the processing vessels by overflow of argon or helium gas.

Thus, one of the advantages of this invention is that the plasma reactor 40 and the refining station 104 are basically one integrated apparatus 100. In this way the reduced titanium tetrachloride in the form of molten titanium droplets exits the reactor 40 directly to the second processing stage. The transition zone 43 from the reactor 40 is between the reactor 40 and the reducing refining zones 102, 104 and thus the molten drops of titanium are not exposed to fresh ambient environment or at least the exposure to fresh ambient environment is minimized. The purity of the plasma gas, argon or helium, were chosen to maximize the purity of the titanium.

In effect, from the time of the formation of the molten titanium, the metal is under controlled conditions and inert gas so that the partial pressures of the gases which are difficult to remove by outgassing are kept at. a minimum. This is achieved by a single integrated apparatus 100 so that the molten titanium metal can be handled and transferred within a controlled environment provided by a single contained apparatus 100 which is effective not only to maintain environmental conditions surrounding the molten titanium under control, but also to exclude contaminant gases.

An additional and valuable option is the ability to alloy the titanium while it is still molten and make a much more valuable titanium alloy, e.g., 4Ti-6Al-4V. This may be accomplished in the right hand section 104 of the device.

Another advantage of this invention is the formation of essentially pure titanium tetrachloride which is then processed to provide essentially pure titanium metal which can be alloyed, as desired. Moreover, while the starting material is a titanium containing ore 17, this is preferred as opposed to the use of titanium dioxide powders since the latter are relatively expensive and may contain impurities which may be difficult to remove and which may adversely impact the overall purity of the final titanium product. Another advantage of the present invention is that the final refining and alloying operation is carried out in a single device 100, under controlled atmosphere pressure conditions, i.e., inert gas environment. These atmospheric conditions are relatively benign in the sense that the atmosphere with which the molten titanium is in contact does not include contaminating gas or gases. Because there is a constant out flow of inert gas the purity of the final product is not compromised by exposure to ambient air and the contaminants in air.

The present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A process for the production of titanium metal comprising the steps of chlorinating titanium bearing ore to form titanium tetrachloride, purifying the titanium tetrachloride, and heating and continuously reacting the titanium tetrachloride at atmospheric pressures under inert gas with a metallic reductant in a plasma to yield molten titanium metal which is further processed in a connected apparatus at atmospheric pressures in an environment of inert gas.

2. The process according to claim 1, wherein the metallic reductant is magnesium.

3. The process according to claim 1, wherein the metallic reductant is selected from the group consisting of lithium, sodium, potassium, rubidium, cesium, francium, beryllium, calcium, strontium, barium and radium.

4. The process according to claim 1, wherein the step of reacting the titanium tetrachloride includes the step of introducing the titanium tetrachloride and the metallic reductant continuously into the focal point of plasma torches.

5. The process according to claim 1, wherein impurities outgas during the further processing under inert gas.

6. The process according to claim 1, wherein the inert gas is selected from the group consisting of argon and helium.

7. The process according to claim 5, wherein the inert gas is selected from the group consisting of argon and helium.

8. The process according to claim 5, further comprising the step of alloying the molten titanium metal with an additional metal.

9. The process according to claim 8, wherein the additional metal is selected from the group consisting of aluminum and vanadium.

10. The process according to claim 8, wherein aluminum and vanadium are introduced into the molten titanium to produce a titanium-aluminum-vanadium alloy.

* * * * *